US008588453B1

(12) United States Patent
Lee

(10) Patent No.: US 8,588,453 B1
(45) Date of Patent: Nov. 19, 2013

(54) REVERSE-DIRECTION CO-AXIAL EARPHONE

(75) Inventor: Pin-Tang Lee, New Taipei (TW)

(73) Assignee: Eastern Technologies Holding Limited, Cayman Islands (KY)

( * ) Notice: Subject to any disclaimer, the term of this patent is extended or adjusted under 35 U.S.C. 154(b) by 0 days.

(21) Appl. No.: 13/603,331

(22) Filed: Sep. 4, 2012

(51) Int. Cl.
*H04R 1/00* (2006.01)
*H04R 1/10* (2006.01)

(52) U.S. Cl.
CPC ..... *H04R 1/1008* (2013.01); *H04R 1/1058* (2013.01)
USPC ..... 381/370; 381/371

(58) Field of Classification Search
USPC ..... 381/74, 370–374, 376, 380; 379/430
See application file for complete search history.

(56) References Cited

U.S. PATENT DOCUMENTS

| | | | | |
|---|---|---|---|---|
| 3,798,393 | A * | 3/1974 | Gorike | 381/372 |
| 4,160,135 | A * | 7/1979 | Gorike | 381/373 |
| 5,134,659 | A * | 7/1992 | Moseley | 381/72 |
| 2011/0007908 | A1 * | 1/2011 | Rosener et al. | 381/74 |

* cited by examiner

*Primary Examiner* — Tuan D Nguyen
(74) *Attorney, Agent, or Firm* — Chun-Ming Shih

(57) ABSTRACT

A reverse-direction co-axial earphone is assembled by the following steps. (a) First, a donut-shaped frame (7) is connected with a T-shaped iron portion (10), a magnet (17) and a permeable U-shaped iron portion (12). Then, a high-frequency connective portion (13) is attached with the U-shaped iron portion (12). Now, a double-magnetic-route element is formed. (b) Next, a low-frequency diaphragm (8) is attached to a low-frequency conductive ring (9), which is then attached to the sound generating unit (7), which is then soldered with a low-frequency connective portion (11). Now, a reverse-direction co-axial sound generating unit with a single magnet and a double-magnetic-route element is assembled. Then, a front cover (3) and a rear cover (4) are fitted to form an air pathway (20), air pathways (21) and air pathways (19).

2 Claims, 5 Drawing Sheets

REVERSE-DIRECTION CO-AXIAL EARPHONE

BACKGROUND OF THE INVENTION

1. Field of the Invention

The invention generally relates to an earphone. More particularly, the invention relates to a reverse-direction co-axial earphone.

2. Description of the Prior Art

There is only a single moving coil driver in a conventional earphone as shown in FIG. 5; therefore, low-frequency sounds may be attained at the cost of high-frequency and mid-frequency sounds. Wherein, a low-frequency diaphragm (8) attached to a low-frequency conductive ring (9) is disposed on the single moving coil driver. Then, a front cover (3) and a rear cover (4) are provided to enclose them. A support frame (5), a soft cushion portion (2) and a dust-proof net (1) may be fitted at outside.

In addition, conventionally, if several moving coil drivers are used to achieve a broader frequency range, cost is increased.

SUMMARY OF THE INVENTION

The present invention is to provide a reverse-direction co-axial earphone with a single magnet and a double-magnetic-route element. Thanks to the double-magnetic-route element, a low-frequency conductive ring and a high-frequency conductive ring, the driving force may be passed on to a low-frequency diaphragm and a high-frequency and mid-frequency diaphragm to achieve the goal of better overall sound effect.

DETAILED DESCRIPTION OF THE PREFERRED EMBODIMENT

Figure 1:
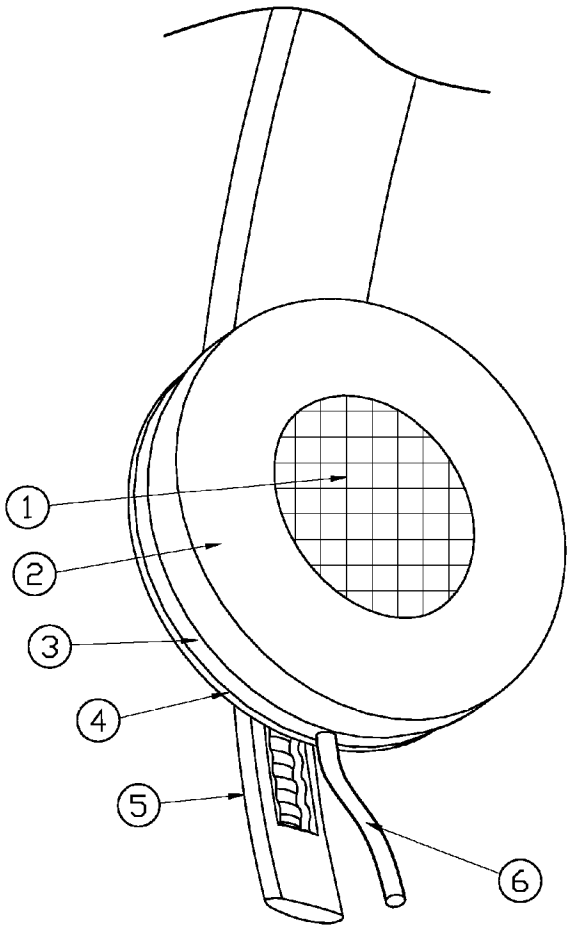
FIG. 1 is a perspective view of the reverse-direction co-axial earphone of the present invention in an assembled condition.
Figure 2:
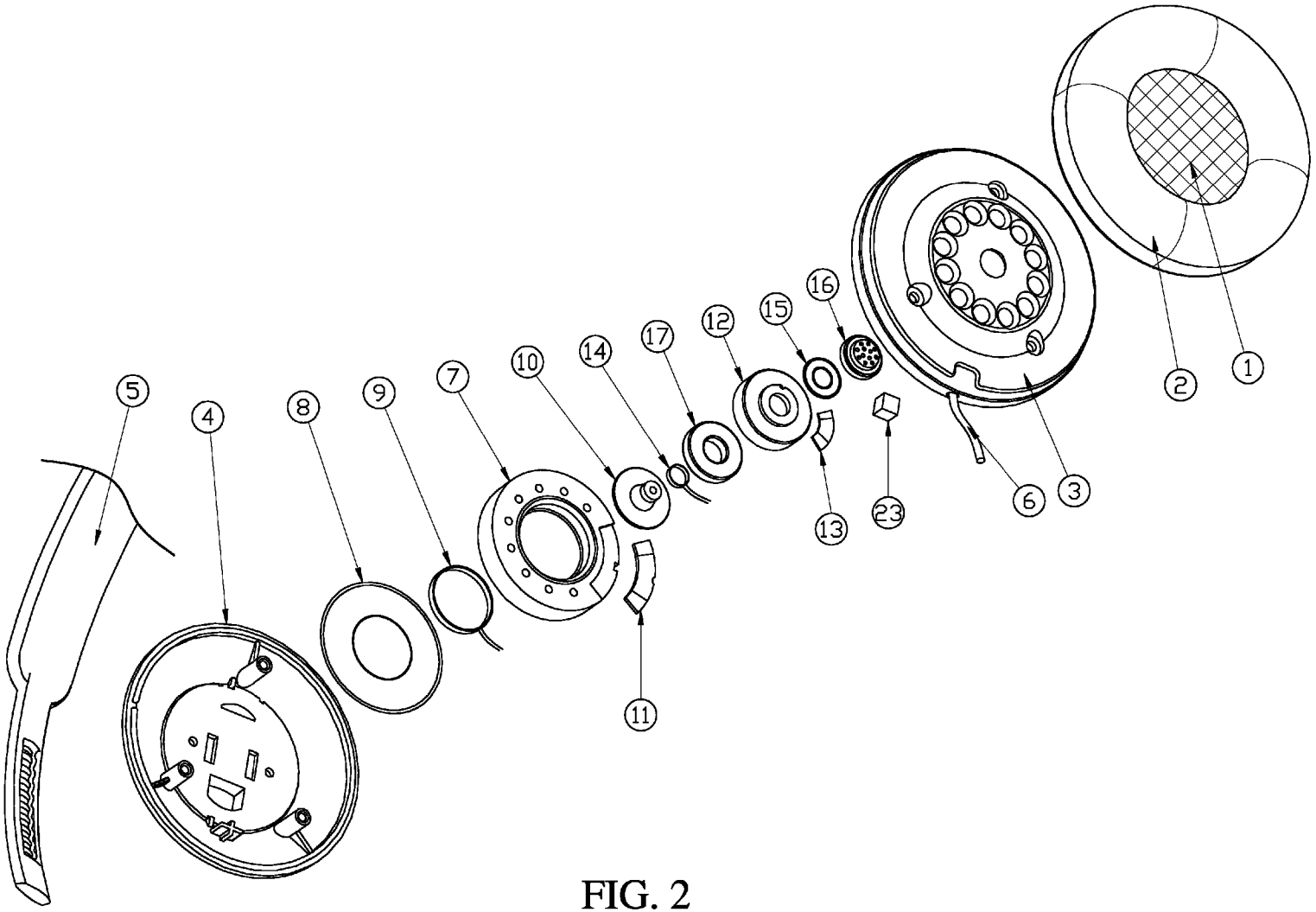
FIG. 2 is an exploded view illustrating the components of the reverse-direction co-axial earphone of the present invention.
Figure 3:
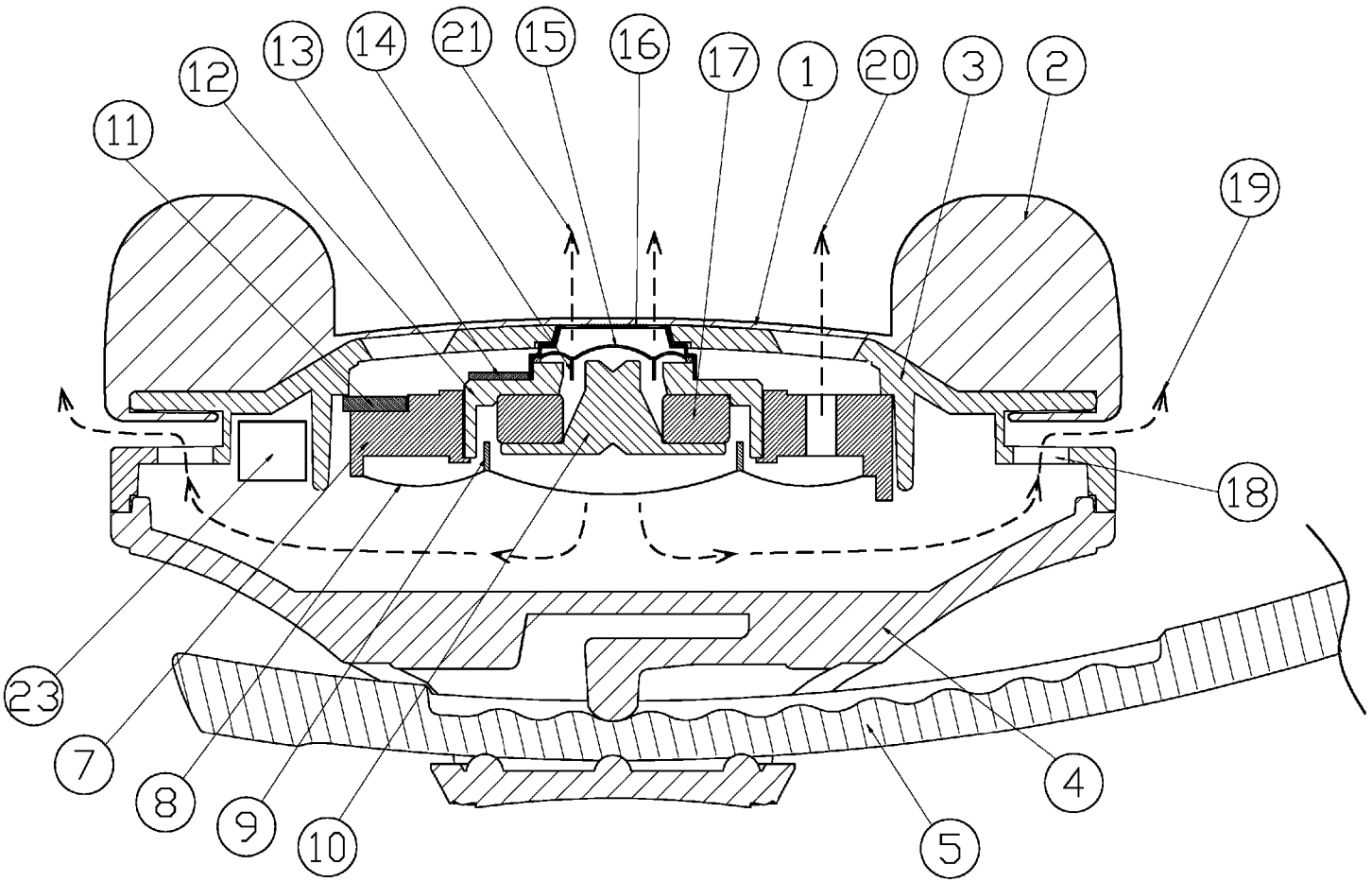
FIG. 3 is a sectional view of the reverse-direction co-axial earphone of the present invention.

Please refer to FIG. 1 to FIG. 4., a donut-shaped frame (7) is connected with a T-shaped iron portion (10), a magnet (17) and a permeable U-shaped iron portion (12), a high-frequency connective portion (13) is attached with the U-shaped iron portion (12). Then, a double-magnetic-route element is formed.

A low-frequency diaphragm (8) is attached to a low-frequency conductive ring (9), which is then attached to the donut-shaped frame (7), and then soldered with a low-frequency connective portion (11).

A high-frequency diaphragm (15) is attached to a high-frequency conductive ring (14), which is then attached to the permeable U-shaped iron portion (12). Then, a dust-proof cover portion (16) is placed so as to protect the high-frequency diaphragm (15) and the high-frequency conductive ring (14). Then, the high-frequency conductive ring (14) is soldered with the high-frequency connective portion (13).

Now, a reverse-direction co-axial sound generating unit with a single magnet and a double-magnetic-route element is assembled.

Figure 4:
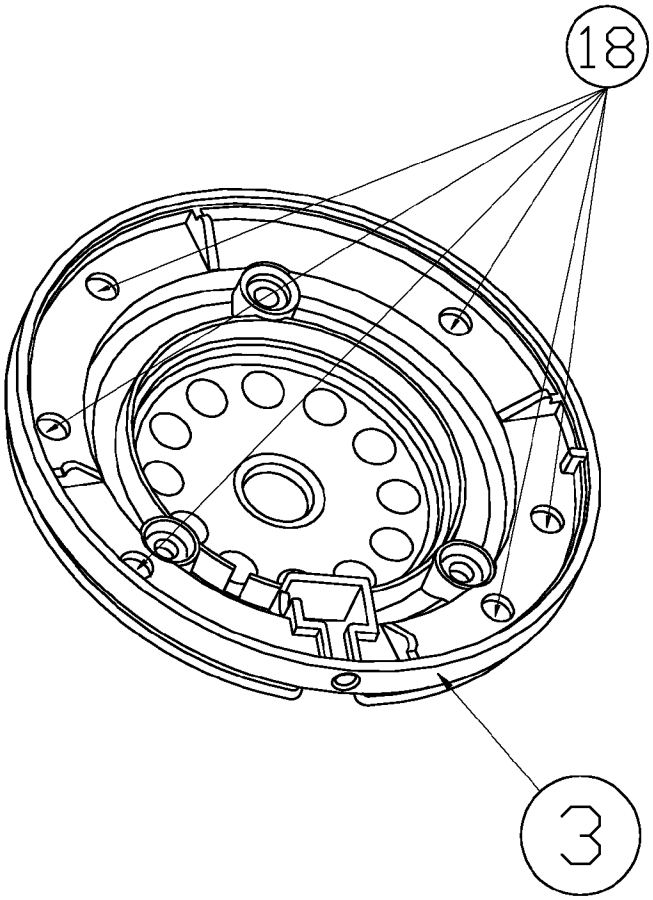
FIG. 4 is a perspective view showing several ventilation holes provided in the front cover.
Figure 5:
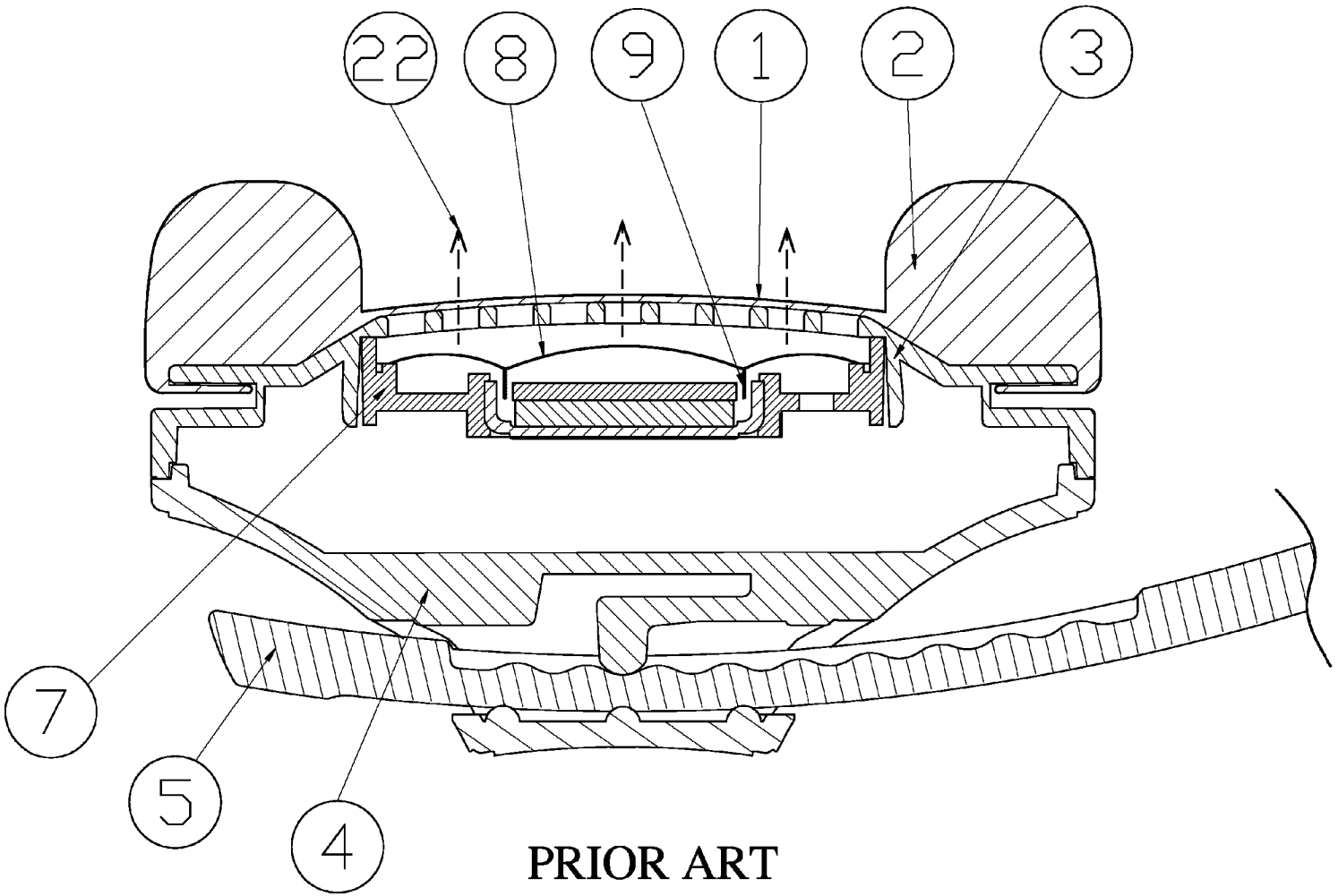
PRIOR ART FIG. 5
FIG. 5 is a sectional view of a conventional earphone.

Then, a front cover (3) and a rear cover (4) are fitted to form an air pathway (20), two air pathways (21) and air pathways (19). In comparison, as illustrated in FIGS. 4 and 5, we can see that the conventional earphone only has air pathways (22).

Through the selection or manipulation of the diameter and number of the ventilation holes, air may be effectively through the air pathways (19) so as to eliminate the stationary waves that could be generated inside the earphone and the goal of clearer sounds may be achieved. In addition, the design of the ventilation holes (18) is unique because they are hidden in the connective portions of the front cover (3); therefore, the ventilation holes (18) do not affect the appearance of the earphone and can achieve the aforesaid goal.

An audio signal line (6) is connected with the sound generating unit. Now, the sound generating unit of the present invention can provide better sounds.

Optionally, a crossover (23) may be provided.

Then, a support frame (5), a soft cushion portion (2) and a dust-proof net (1) may be fitted to the sound generating unit. Now, the reverse-direction co-axial earphone of the present invention is completely assembled.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An earphone, comprising:

a donut-shaped frame (7) connected with a T-shaped iron portion (10), a magnet (17) and a permeable U-shaped iron portion (12), and a high-frequency connective portion (13) attached with the permeable U-shaped iron portion (12) to form a double-magnetic-route element;

a low-frequency diaphragm (8) attached to a low-frequency conductive ring (9), which is then attached to the donut-shaped frame (7), and then soldered with a low-frequency connective portion (11) disposed on the donut-shaped frame (7);

a high-frequency diaphragm (15) attached to a high-frequency conductive ring (14), which is then attached to the permeable U-shaped portion (12); and a dust-proof cover portion (16) is fitted so as to protect the high-frequency diaphragm (15) and the high-frequency conductive ring (14), wherein the high-frequency conductive ring (14) is soldered with the high-frequency connective portion (13) and a reverse-direction co-axial sound generating unit including the double-magnetic-route element with a single magnet and is assembled.

2. The earphone as in claim 1, wherein a plurality of ventilation holes (18) are hidden in connective portions of the front cover (3) and through selection or manipulation of diameter and number of the ventilation holes, air pathways (19) are formed to let out air and to achieve a goal of better sound effect.

* * * * *